US012566045B1

(12) United States Patent
Vermeulen

(10) Patent No.: US 12,566,045 B1
(45) Date of Patent: Mar. 3, 2026

(54) REAR FIREARM SIGHT SLIDE ELEVATOR

(71) Applicant: Blue Sky Montana Roots, LLC, Great Falls, MT (US)

(72) Inventor: David Joseph Vermeulen, Great Falls, MT (US)

( * ) Notice: Subject to any disclaimer, the term of this patent is extended or adjusted under 35 U.S.C. 154(b) by 0 days.

(21) Appl. No.: 18/976,139

(22) Filed: Dec. 10, 2024

Related U.S. Application Data

(63) Continuation-in-part of application No. 18/818,392, filed on Aug. 28, 2024, now Pat. No. 12,405,085.

(51) Int. Cl.
*F41G 1/28* (2006.01)

(52) U.S. Cl.
CPC ..... *F41G 1/28* (2013.01)

(58) Field of Classification Search
CPC ..... F41G 1/28; F41G 1/16
USPC ..... 42/136
See application file for complete search history.

(56) References Cited

U.S. PATENT DOCUMENTS 160,819 A * 3/1875 Freund ..... F41G 1/28 42/136
198,279 A * 12/1877 Decker ..... F41G 1/28 42/136
353,786 A * 12/1886 Halladay ..... F41G 1/28 42/136
434,785 A * 8/1890 Horner ..... F41G 1/28 42/136
659,929 A * 10/1900 Johnson ..... F41G 1/28 42/136
667,628 A * 2/1901 Johnson ..... F41G 1/28 42/136
670,012 A 3/1901 Brougher
682,739 A 9/1901 Parsons
847,953 A * 3/1907 La Riviere ..... F41G 1/28 42/136
880,310 A 2/1908 Klousnitzer
920,767 A * 5/1909 Lindberg ..... F41G 1/28 42/136
1,018,876 A * 2/1912 Chadwick ..... F41G 1/28 42/136
1,147,469 A * 7/1915 Webb ..... F41G 1/28 42/136
1,288,379 A * 12/1918 Burton ..... F41G 1/28 42/136

(Continued)

FOREIGN PATENT DOCUMENTS

GB 1909 25253 A 3/1910
GB 191311232 A 10/1913
GB 191502095 A 10/1915

*Primary Examiner* — Jonathan C Weber
(74) *Attorney, Agent, or Firm* — Antoinette M. Tease

(57) ABSTRACT

A rear firearm sight slide elevator with a base member that is configured to surround a part of a firearm barrel and first and second clips that are situated on top of the base member and parallel to each other, with the first clip situated along a first side of the base member and the second clip situated on a second side of the base member. Each clip has a top part in the form of an elongated member, a bottom part in the form of an elongated ramp, and a hinge that connects the top part to the bottom part at a rear end of the clip. The elongated member includes a plurality of teeth that extend downwardly from a bottom surface of the elongated member. The hinge may be rounded or rectangular in shape.

9 Claims, 13 Drawing Sheets

(56) References Cited

U.S. PATENT DOCUMENTS

| | | | | | |
|---|---|---|---|---|---|
| 1,293,551 | A | * | 2/1919 | Riser | F41G 1/28<br>42/136 |
| 1,464,615 | A | * | 8/1923 | Nelson | F41G 1/26<br>42/136 |
| 1,715,203 | A | | 5/1929 | Loomis | |
| 1,922,302 | A | * | 8/1933 | King | F41G 1/10<br>42/136 |
| 2,398,309 | A | * | 4/1946 | Howell | F41G 1/18<br>42/136 |
| 2,511,245 | A | | 6/1950 | Caster | |
| 3,199,202 | A | | 8/1965 | Williams | |
| 3,834,035 | A | | 9/1974 | Merrill | |
| 3,975,851 | A | | 8/1976 | Benford | |
| 7,540,108 | B2 | | 6/2009 | Irwin | |
| 8,919,027 | B2 | | 12/2014 | Curry | |

* cited by examiner

REAR FIREARM SIGHT SLIDE ELEVATOR

CROSS-REFERENCE TO RELATED APPLICATION

Pursuant to 35 U.S.C. § 120, this application claims priority back to and is a continuation-in-part of U.S. patent application Ser. No. 18/818,392 filed on Aug. 28, 2024, the contents of which are incorporated herein by reference.

BACKGROUND OF THE INVENTION

1. Field of the Invention

The present invention relates generally to the field of firearm accessories, and more particularly, to a rear firearm sight slide elevator.

2. Description of the Related Art

Rear firearm sight elevators are used to adjust sight elevation settings by raising and lowering the rear sight of a firearm. The rear firearm sight step elevator is a commonly used type of rear firearm sight elevator. Conventional rear firearm sight step elevators are in the form of a single- or double-step rear sight elevator that is configured to raise and lower the rear sight of a firearm, thereby changing the sight elevation setting, using sight elevation steps. A single-step rear sight elevator has one stepping surface or "fin" (in the form of a staircase) that is used to raise the rear firearm sight. A double-step rear sight elevator has two parallel fins (increasing in height from rear to front) that are joined together by a base plate.

In single-step rear sight elevators, the elevator runs parallel to the barrel and down the center of the sight path of the rear sight of a firearm. This prevents single-step rear sight elevators from being used for higher sight elevation settings because the elevator would obstruct the sight path if it were made to be taller. Double-step rear sight elevators become exposed from under the rear sight of a firearm at certain settings, which makes them prone to unintentional lateral movements. This unintentional lateral movement can cause undesired sight elevation changes. Thus, there is a need for a rear firearm sight elevator that can provide higher sight elevation settings without obstructing the sight path or being prone to unintentional lateral movements.

Single- and double-step rear sight elevators have sight elevation steps that are difficult to force under the rear sight of a firearm. The rear sight of a firearm usually needs to be raised to relieve pressure from the rear firearm sight step elevator before the elevator can be moved to make sight elevation setting changes. This requires the operator to use both of his hands, thereby obstructing the operator's view of the rear firearm sight step elevator and the rear sight of the firearm, and it often requires the operator to move the firearm from the shooting position, additionally complicating and slowing down the process of changing sight elevation settings.

Single- and double-rear sight step elevators have a small amount of exposed surface area to contact and grip, which makes them difficult to adjust. This small amount of exposed surface area only allows for contact by an operator's fingertips. This makes maintaining an effective grip while adjusting a rear firearm sight step elevator extremely difficult, especially for operators with cold fingers, a weak grip, or when the operator is wearing gloves. Accordingly, sight elevation setting changes are slow and, for some operators, nearly impossible. What is needed is a rear firearm sight elevator that (a) is easy to contact and grip; (b) is quickly, smoothly and easily adjusted without requiring the operator to lose sight of the rear firearm sight elevator and the rear sight of the firearm or to move the firearm out of a shooting position; and (c) without requiring a significant amount of physical pressure from the operator.

Single- and double-step rear sight elevators have little exposed surface area, which makes putting detailed and legible sight elevation reference markings on them unfeasible. As a result, an operator who is unfamiliar with the rear firearm sight elevator will be unable to change sight elevation settings quickly and effectively. For this reason, there is also a need for a rear firearm sight elevator that has a relatively large exposed surface area on which detailed and legible sight elevation reference markings may be displayed.

U.S. Pat. No. 3,975,851 (Benford, 1976) discloses a gun sight that is detachably mounted on the rear of the barrel. In one embodiment, the invention includes an elevation bar that is mounted directly underneath the sight to provide adjustable elevation of the sight. The elevation bar has steps and does not provide smooth elevation as in the present invention, which has a smooth ramp. The Benford invention also does not include fins or sight markings and is a whole sight system requiring gunsmithing to install. Unlike the present invention, it is not an improved elevator that can be installed by a lay person in two seconds.

U.S. Pat. No. 920,767 (Lindberg, 1909) provides a gun sight with a slide that is configured to raise or lower the height of the sight. This particular invention is an integrated sight-elevator system; it is not a separate slide elevator that can be used with an existing rear sight. It is structurally distinguishable from the present invention in that it does not incorporate fins or sight markings and is a whole sight system requiring gunsmithing to install, among other differences. The rear sight in the Lindberg invention is pivotally attached to the sight "body" or what is referred to in the present application as the sight "arm." The rear sight itself is not part of the present invention, and the sight with which the present invention is used is not pivotally attached to the arm. The elevator of the Lindberg invention is similar to a single-step sight elevator without the steps.

U.S. Pat. No. 682,739 (Parsons et al., 1901) discloses an adjustable rear sight system that is semi-permanently affixed to the rifle. By contrast, the present invention is a rear sight slide elevator (not a rear sight system) that is easily detachable. The Parsons invention incorporates a pin or pivot that is configured to move the sight-leaf laterally relative to the rear sight via the longitudinal movement of the pin. It also includes a slide that is placed onto the leaf-spring. The present invention is one solid piece rather than several moving parts that require gunsmithing to be installed on a firearm, as in Parsons.

U.S. Pat. No. 670,012 (Brougher, 1901) provides a rear firearm sight that incorporates a double-step sight elevator. The elevation of the sight is adjusted via a dial-and-gear system that is not part of the present invention. None of the inventions discussed above offers the structural and functional advantages of the present invention, which is discussed more fully below.

BRIEF SUMMARY OF THE INVENTION

The present invention is a rear firearm sight slide elevator comprising: a base member; wherein the base member is configured to surround a part of a firearm barrel; and a first clip and a second clip; wherein the first clip and the second clip are situated on top of the base member and parallel to each other, with the first clip situated along a first side of the base member and the second clip situated on a second side of the base member; wherein each of the first clip and the second clip comprises a top part in the form of an elongated member, a bottom part in the form of an elongated ramp, and a hinge that connects the top part to the bottom part at a rear end of the clip; and wherein the elongated member comprises a plurality of teeth that extend downwardly from a bottom surface of the elongated member. In one embodiment, the hinge is rounded. In another embodiment, the hinge is comprised of a first edge, a second edge, and a third edge, the second edge connecting the first edge to the third edge, the angle between the first and second edges being equal to or less than ninety degrees, and the angle between the second and third edges being equal to or less than ninety degrees.

In a preferred embodiment, the ramp comprises a top surface that is smooth. In an alternate embodiment, the ramp comprises a top surface that is comprised of discrete steps. In another preferred embodiment, the teeth are of equal width and evenly spaced. In an alternate embodiment, the teeth are not of equal width and are not evenly spaced.

Optionally, the invention further comprises a bridge that is connected on one end to a top surface of the elongated member on the first clip and one another end to a top surface of the elongated member on the second clip. Also optionally, the invention comprises a pair of wings that extend forwardly from either side of a front end of the base member.

REFERENCE NUMBERS

Figure 1:
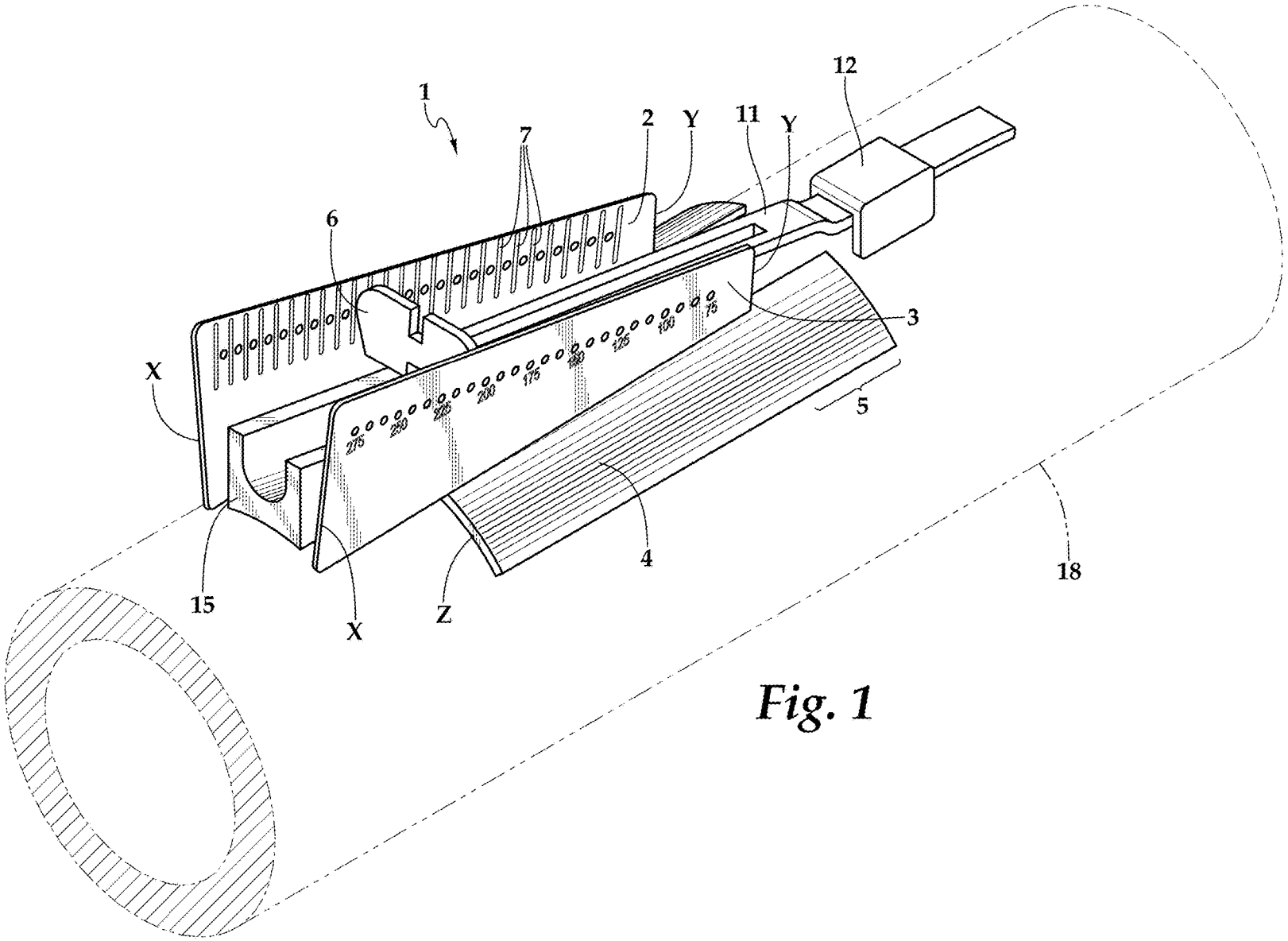
FIG. 1 is a rear perspective view of the present invention shown with the rear firearm sight slide elevator installed on a firearm barrel.

1 Rear firearm sight slide elevator
2 First fin
3 Second fin
4 Base member
5 Wings (of base member)
6 Rear firearm sight (not part of the present invention)
7 Ridges
8 Channel (in ramp)
9 Apertures
10 Central portion (of base member)
11 Arm
12 Bracket
13 Single-step rear sight elevator (prior art)

14 Bump (on front end of central portion of base member)
15 Ramp (on central portion of base member)
16 Sight markings
17 Gap
18 Firearm barrel
19 Base member
19*a* Bottom edge (of base member)
20 Clip
21 Rounded hinge
22 Elongated ramp
23 Elongated member
23*a* Tapered front end (of elongated member)
24 Teeth
25 Arch-shaped bridge
26 Wings (of base member)
27 Rectangular hinge
27*a* First edge (of rectangular hinge)
27*b* Second edge (of rectangular hinge)
27*c* Third edge (of rectangular hinge)

DETAILED DESCRIPTION OF INVENTION

FIG. 1 is a rear perspective view of the present invention shown with the rear firearm sight slide elevator installed on a firearm barrel. As shown in this figure, the present invention 1 comprises a first fin 2 and a second fin 3, These fins 2, 3 are parallel to each other and are situated on top of a concave-shaped base member 4. The base member 4 is configured to surround part of the firearm barrel. Part of the bottom edge of the first fin 2 is connected to one side of the top of the base member 4, and part of the bottom edge of the second fin 3 is connected to the other side of the top of the base member 4. In a preferred embodiment, at least half of the bottom edge of each fin 2, 3 is connected to the top of the base member 4. This base member 4 is comprised of two forward wings 5 and a central portion 10. The central portion of the base member 4 underlies the bottom edges of the first and second fins 2, 3 for at least half the length of the fin.

For reference, the proximal end of each fin (that is, that part of the fin that is closest to the stock of the firearm) is marked as "X" (see also FIG. 12), and the distal end of each fin (that is, that part of the fin that is closest to the muzzle of the firearm) is marked as "Y" in FIG. 1. In a preferred embodiment, the two fins 2, 3 are of equal length, and the base member 4 is approximately as long as the fins. Note that the wings 5 of the base member 4 extend past the distal end Y of the fin. As noted above, the base member 4 is configured to hug the top part of the barrel 18, and the fins 2, 3 are situated atop the base member 4. The purpose of the base member 4 is not only to support the ramp 15 but also (together with the wings 5) to reduce any lateral movement of the sight slide elevator 1 on the firearm barrel.

In a preferred embodiment, the degree of concavity of the base member 4 is preferably approximately the same as the degree of convexity of the outside of the firearm barrel. A ramp 15 is situated on top of the central portion 10 of the base member 4. This ramp 15 is smooth (i.e., it does not have steps) and increases in height from the distal end of the ramp (closest to the firearm muzzle) to the proximal end of the ramp (closest to the firearm stock). Similarly, the height of each fin increases from the distal end to the proximal end of each fin; however, the height of the ramp is always less than the height of each fin. Also, the height of each fin increases at the same rate as the height of the other fin so that both fins are equal in height at all points along the length of the fins. The ramp 15 comprises a channel 8, the purpose of which is to provide a sight path through the ramp 15.

In a preferred embodiment, there is a bump or protrusion 14 on top of the base member 4 at the distal (or front) end of the central portion 10 of the base member directly in front of the distal (or front) end of the ramp 15. The purpose of this bump 14 is to secure the rear firearm sight 6 in a first position; as manual pressure is applied to the sight elevator in a distal direction (pushing the sight elevator underneath the sight and toward the muzzle end of the barrel), the sight moves up and onto the ramp. As further pressure is applied, the sight moves further up the ramp, thereby increasing the height of the sight. The proximal ends of the fins 2, 3 provide a relatively large surface for the user's fingers and/or thumb to manipulate the sight elevator.

In a preferred embodiment, each fin 2, 3 comprises a plurality of parallel ridges 7 spaced equally apart from one another on the inside surface of the fin. These parallel ridges 7 are preferably situated on a top part of the inside surface of the fin above the base member 4 and above the ramp 15. In between each set of adjacent parallel ridges is a small, preferably circular, aperture 9. The apertures 9 on both fins are aligned laterally so that when the rear sight 6 is situated between two pairs of adjacent ridges 7 on either side of the rear sight 6, the aperture 9 on either fin is blocked by the rear sight 6. In this manner, the operator can tell where the rear sight is simply by viewing the side of either fin. Optionally, the first two ridges 7 (on the distal end of the sight elevator, proximate to the bump 14) are thicker than the rest of the ridges 7. As noted above, the base member 4 (except for the wings 5) is situated underneath the two fins 2, 3 and has a concave bottom surface (marked as "Z" in FIG. 1) that matches the curvature of the outside of the barrel. The bottom surface of the ramp may also be concave to conform to the shape of the firearm barrel.

Figure 2:
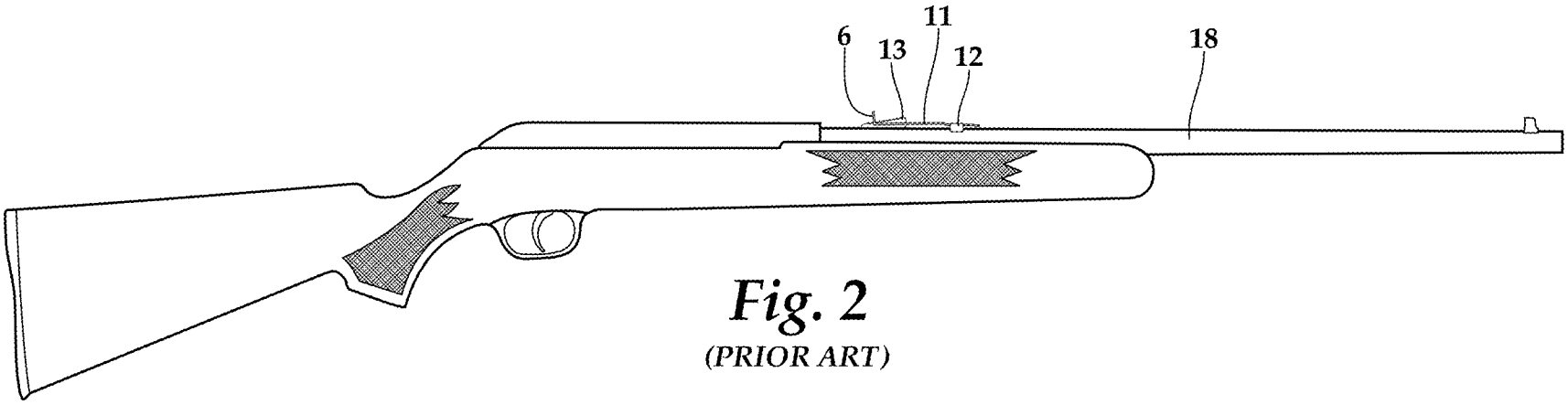
Fig. 2 (PRIOR ART)
FIG. 2 is a side view of a rifle with a prior art single-step rear firearm sight elevator installed on the firearm.
Figure 3:
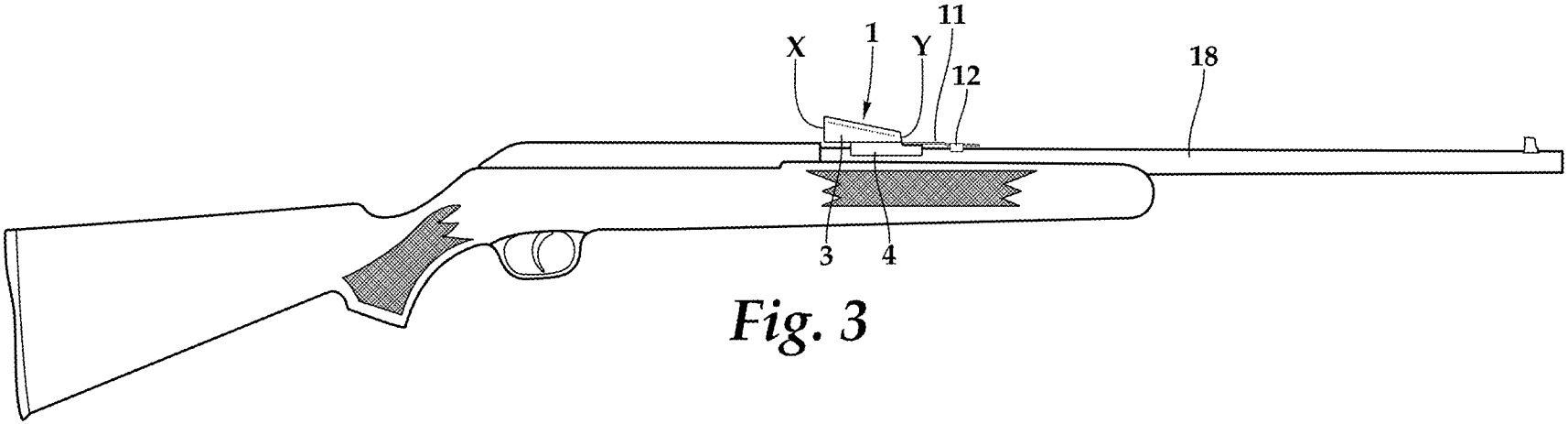
FIG. 3 is a side view of a rifle with the rear firearm sight slide elevator of the present invention installed on the firearm.

FIG. 2 is a side view of a rifle with a prior art single-step rear firearm sight elevator installed on the firearm, and FIG. 3 is a side view of a rifle with the rear firearm sight slide elevator of the present invention installed on the firearm. The purpose of these two figures is to illustrate that the present invention provides a greater surface area for gripping the fins of the sight elevator than the prior art version shown in FIG. 2. These two figures also show where the sight elevator is located on the firearm. The present invention is typically used with all rifles that have a leaf-spring-mounted rear sight as depicted in FIG. 1 (examples of such rifles includes, but are not limited to, the Savage Model 62 and the Sport King Carbine Model A-102).

Figure 4:
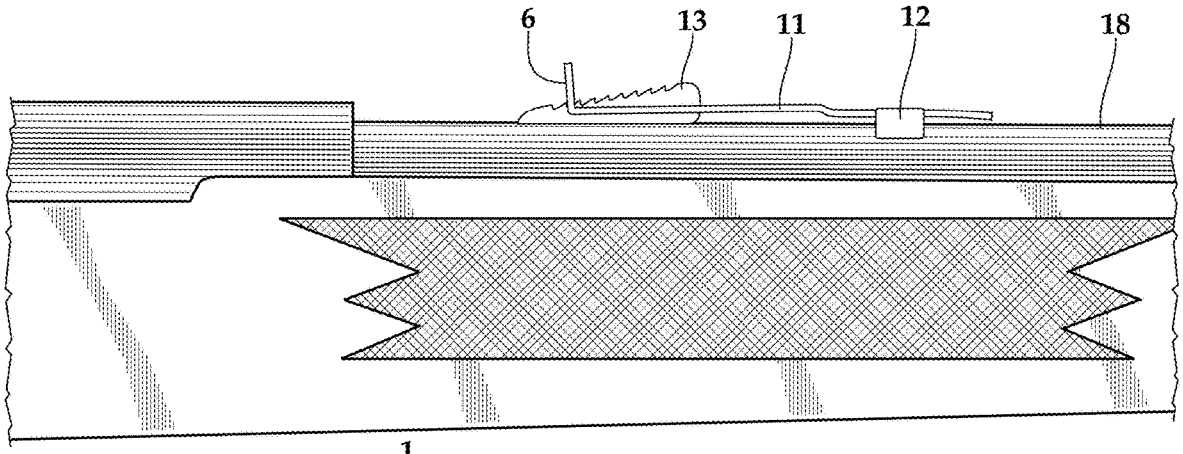
Fig. 4 (PRIOR ART)
FIG. 4 is a detail side view of a prior art single-step rear firearm sight elevator installed on the firearm.

FIG. 4 is a detail side view of a prior art single-step rear firearm sight elevator installed on the firearm. As shown in this figure, the rear sight 6 is connected to an arm 11 that is secured to the barrel by a bracket 12. The arm 11 is configured to hold the rear sight 6 flat against the barrel, but the single-step sight elevator 13 can be used to raise the sight by varying degrees. The single-step sight elevator 13 shown in this figure is inserted into a slot (not shown) in the arm 11 and then slid rearward until the sight 6 is at the desired level on the sight elevator 13. The further rearward the sight elevator is slid, the further the sight is raised. The arm 11 acts as a leaf spring to hold the sight 6 in place on the sight elevator, which includes a number of steps (as described above). With each successive step, the sight is raised higher.

Figure 5:
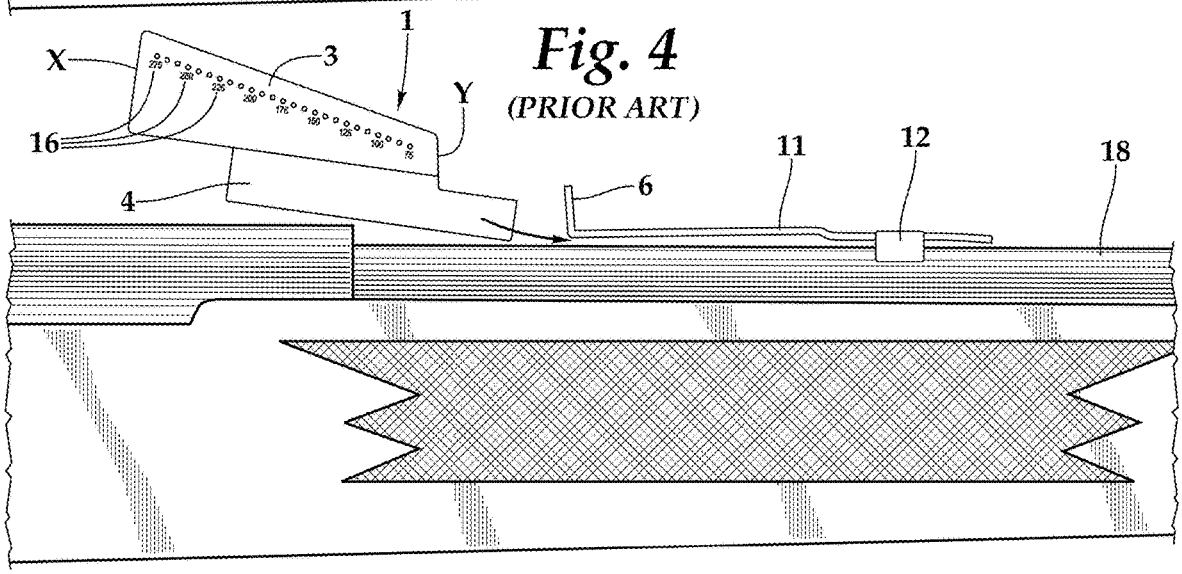
FIG. 5 is a detail side view of the rear firearm sight slide elevator of the present invention shown in relation to the rear sight of the firearm prior to installation.
Figure 6:
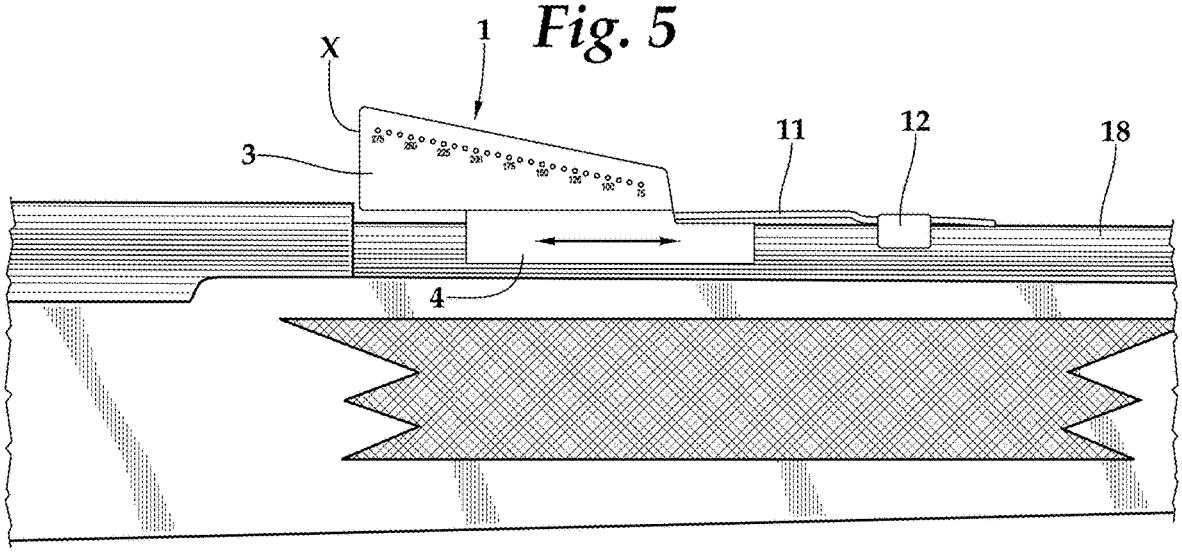
FIG. 6 is a detail side view of the rear firearm sight slide elevator of the present invention shown in relation to the rear sight on the firearm after installation.

FIG. 5 is a detail side view of the rear firearm sight slide elevator of the present invention shown in relation to the rear sight of the firearm prior to installation, and FIG. 6 is a detail side view of the rear firearm sight slide elevator of the present invention shown in relation to the rear sight on the firearm after installation. As shown in these two figures, the wings 5 are first positioned on either side of the front end of the arm 11 with the sight 6 abutting up against the front end of the base member 4. Manual pressure is then applied to the sight elevator 1, and the elevator is pushed in a distal direction (toward the muzzle of the firearm). This pressure causes the rear sight 6 to pass over the bump 14 and up onto the ramp 15. As further pressure is applied by the operator in a distal direction, the sight rises further up on the ramp 15, thereby raising the position of the sight 6 relative to the front firearm sight, causing the operator to raise the muzzle end of the firearm to maintain alignment of the front and rear sights. It should be noted that during this entire procedure, the operator's view of the front and rear firearm sights is never blocked by the sight elevator. Note that the apertures 9 are preferably configured in a line that is parallel to the top surface of the fin and, therefore, at a diagonal angle relative to the longitudinal axis of the firearm.

Figure 7:
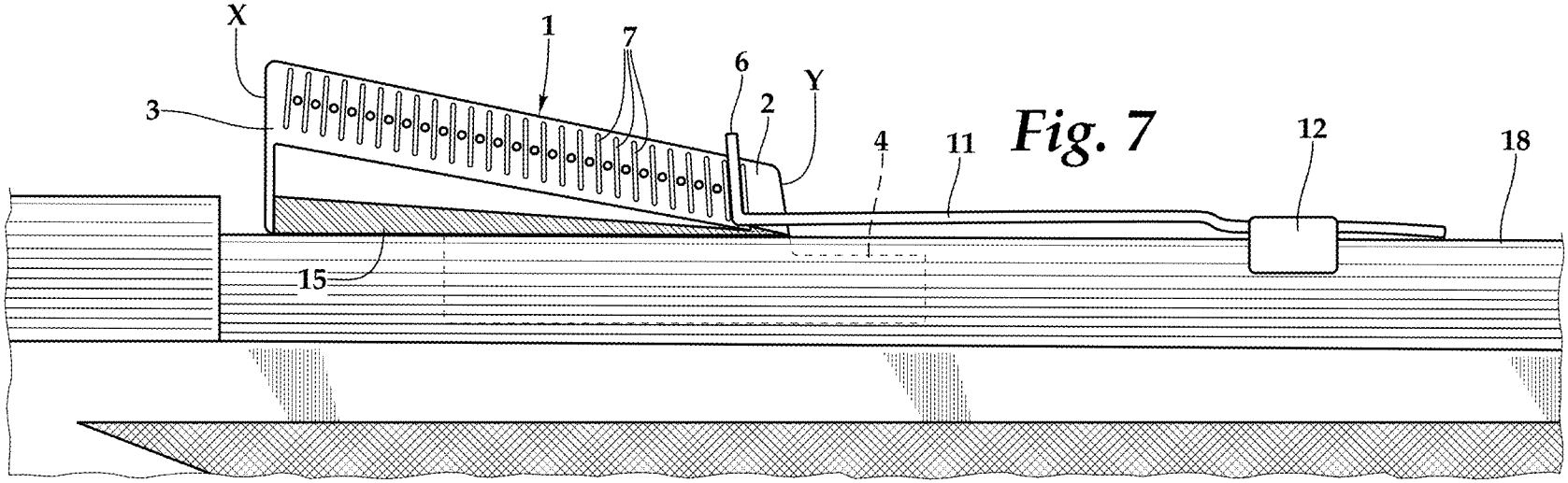
FIG. 7 is a detail section view of the present invention installed on the firearm with the rear sight in a first position in relation to the rear firearm sight elevator.

FIG. 7 is a detail section view of the present invention installed on the firearm with the rear sight in a first position in relation to the rear firearm sight elevator. In this figure, the muzzle end of the firearm (not shown) is to the right, and the firearm stock (not shown) is to the left. This figure shows the sight 6 in relation to the first fin 2 after the sight 6 has cleared the bump 14 on the distal end of the base member 4 at the bottom of the ramp 15. As shown, the lateral edge of the sight 6 is situated between two of the ridges 7 and is blocking one of the apertures 9.

Figure 8:
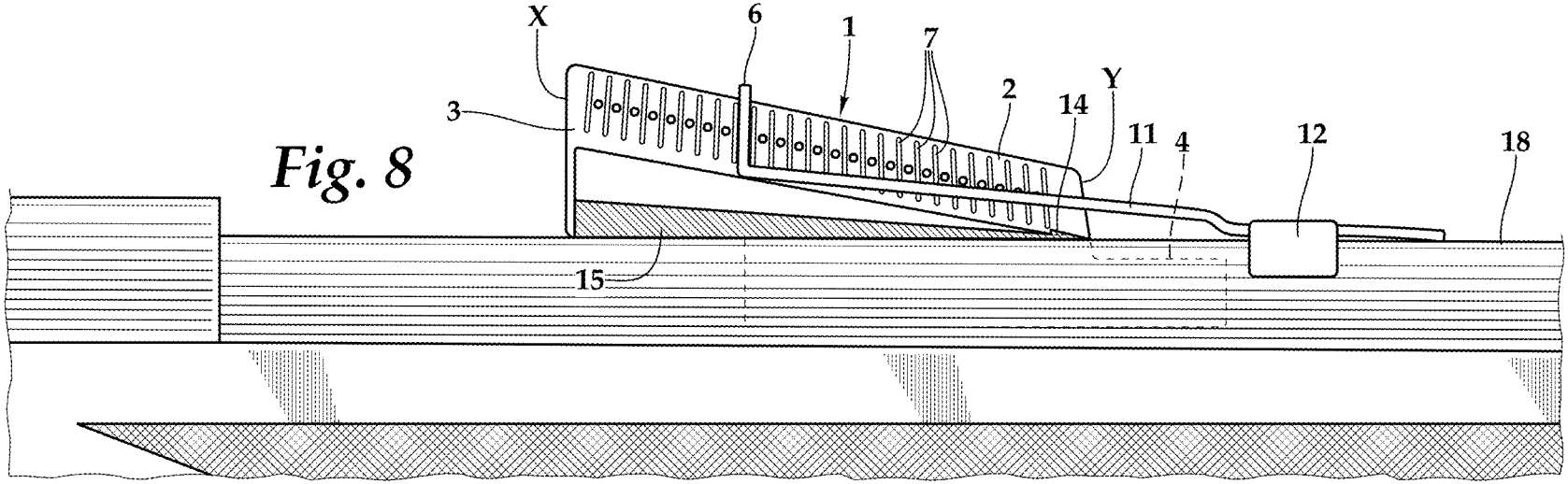
FIG. 8 is a detail section view of the present invention installed on the firearm with the rear sight in a second position in relation to the rear firearm sight elevator.

FIG. 8 is a detail section view of the present invention installed on the firearm with the rear sight in a second position in relation to the rear firearm sight elevator. In this figure, the elevator 1 has been pushed manually by the operator in a distal direction (toward the muzzle or to the right in FIG. 8). As this happens, the sight 6 rides higher up on the ramp 15 and is raised relative to the front sight (not shown), which requires the operator to raise the muzzle end of the firearm in order to maintain alignment of the front and rear sights.

Figure 9:
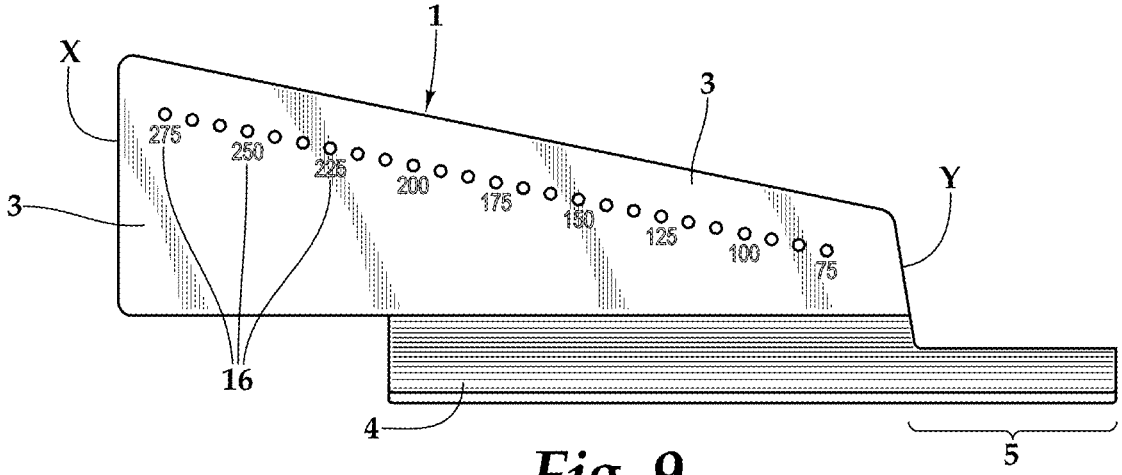
FIG. 9 is a side view of the present invention.

FIG. 9 is a side view of the present invention. As shown in this figure, the invention preferably includes sight markings 16 on the outside surface of at least one of the fins 2, 3 directly underneath at least some of the plurality of apertures 9. Thus, each fin must have sufficient surface area to display the sight markings. The purpose of the sight markings is to assist the operator in determining how far up the ramp 15 to push the sight 6 to achieve the desired shooting range.

Figure 10:
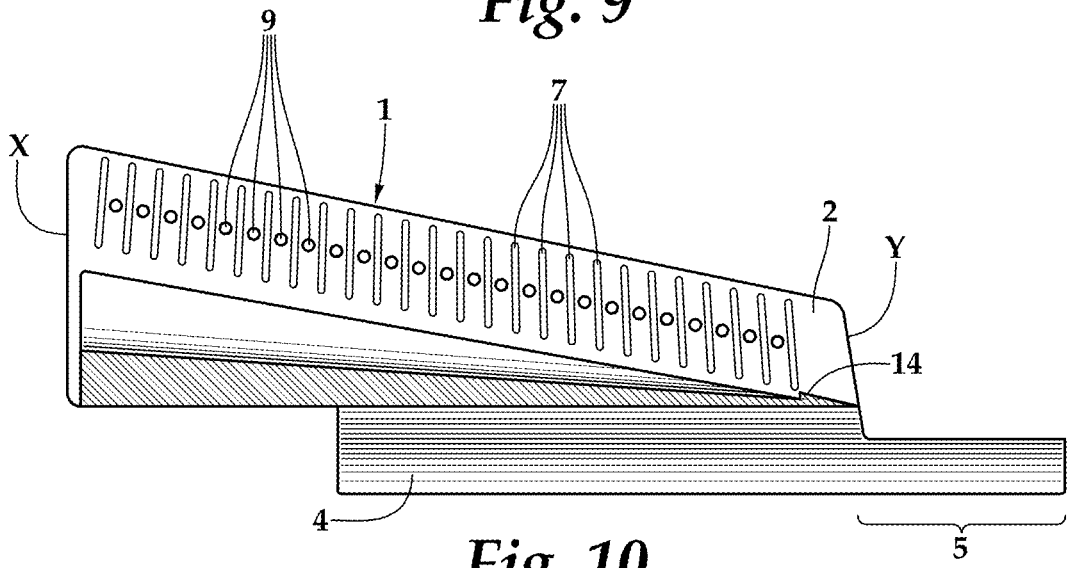
FIG. 10 is a longitudinal section view of the present invention.

FIG. 10 is a longitudinal section view of the present invention. This is the same view as is shown in FIG. 7 except that the rear sight and firearm have been omitted.

Figure 11:
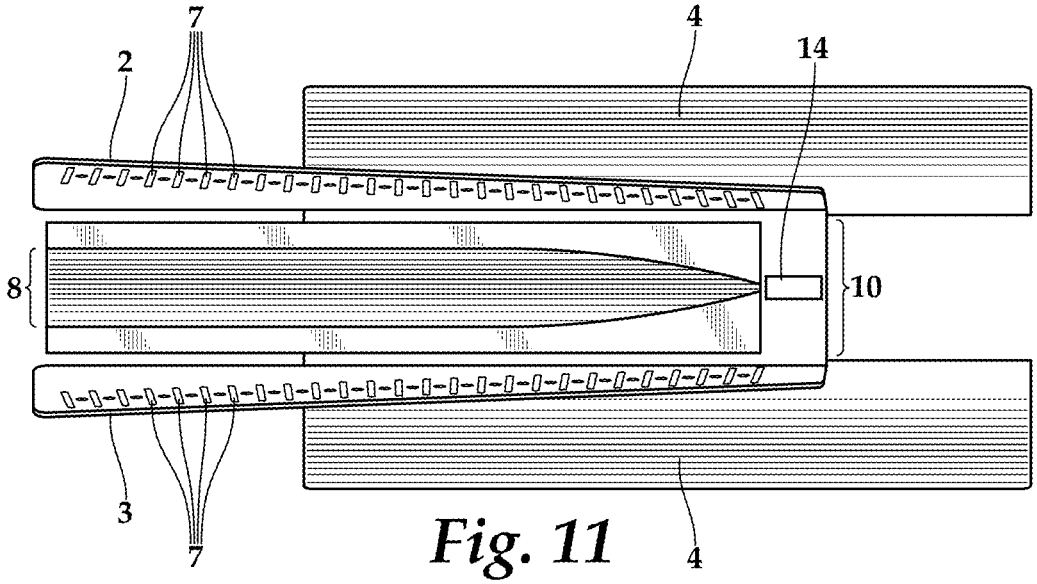
FIG. 11 is a top view of the present invention.

FIG. 11 is a top view of the present invention. This figure clearly shows the bump 14 on the distal end of the central portion 10 of the base member 4. As shown in this figure, the channel 8 preferably tapers to a point directly behind (on the proximal side of) the bump 14. This figure also shows that the two fins 2, 3 are preferably splayed slightly in an outward direction from bottom to top. This enables the user to obtain a bit of flex of the fins when gripping them. Note also that the fins 2, 3 terminate at or near the front edge of the central portion 10 of the base member 4.

Figure 12:
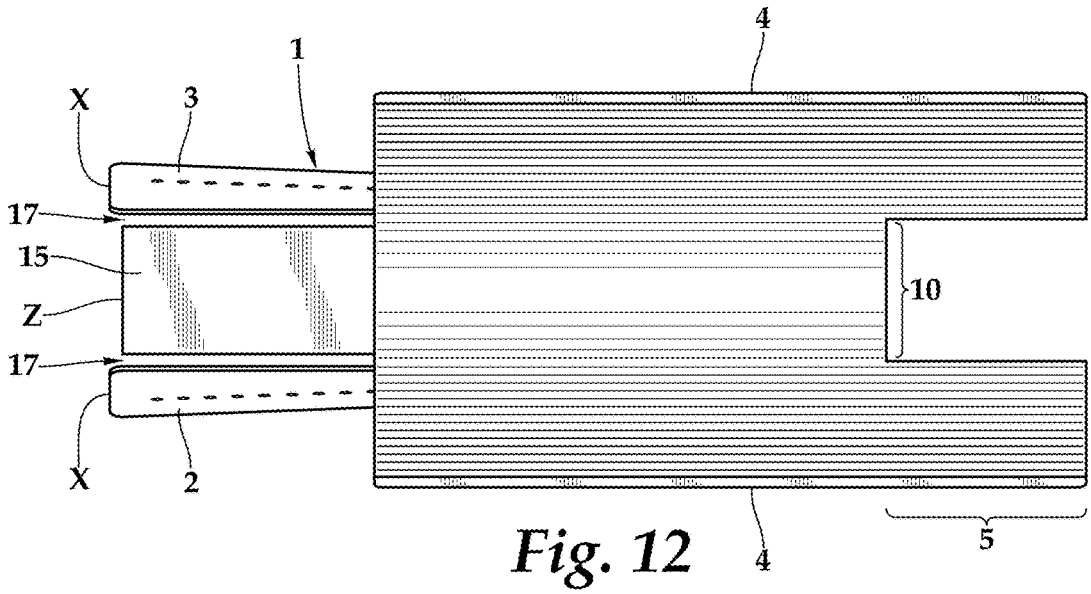
FIG. 12 is a bottom view of the present invention.

FIG. 12 is a bottom view of the present invention. As shown here, the wings 5 are of equal length, and both the fins 2, 3 and the ramp 15 extend past the proximal (or rear) end of the base member 4 (see also FIG. 3) for a distance that is equal to approximately one-third (⅓) of the entire length of the fins and approximately one-half (½) of the length of the central portion of the base member. (In this figure, "proximal" is to the left, and "distal" is to the right.) Note that there is preferably a gap 17 on either side of the ramp 15 between the outside walls of the ramp and the fins 2, 3 on either side of the ramp. The presence of this gap 17 allows the operator to squeeze the fins together when gripping the sight elevator or to fit the user's thumb knuckle in between the two fins in order to separate them apart to slide the sight elevator backwards (toward the user).

Figure 13:
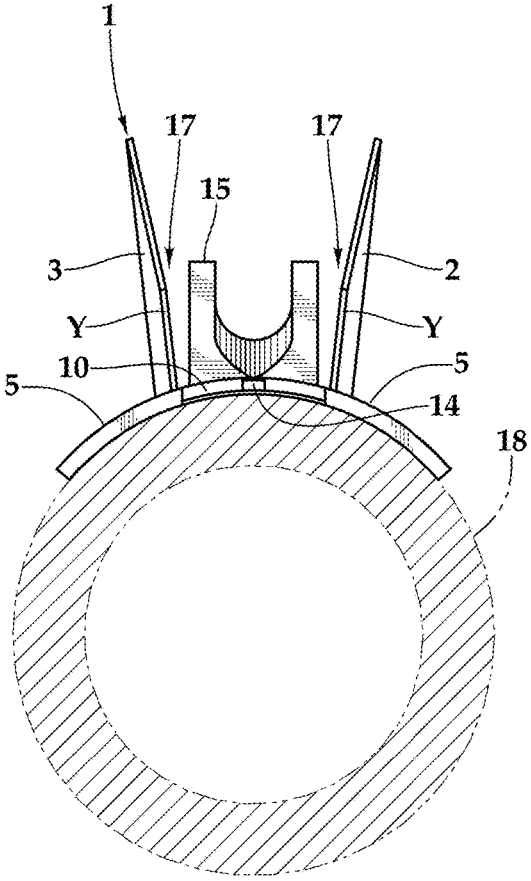
FIG. 13 is a front view of the present invention shown in relation to a circular firearm barrel.
Figure 14:
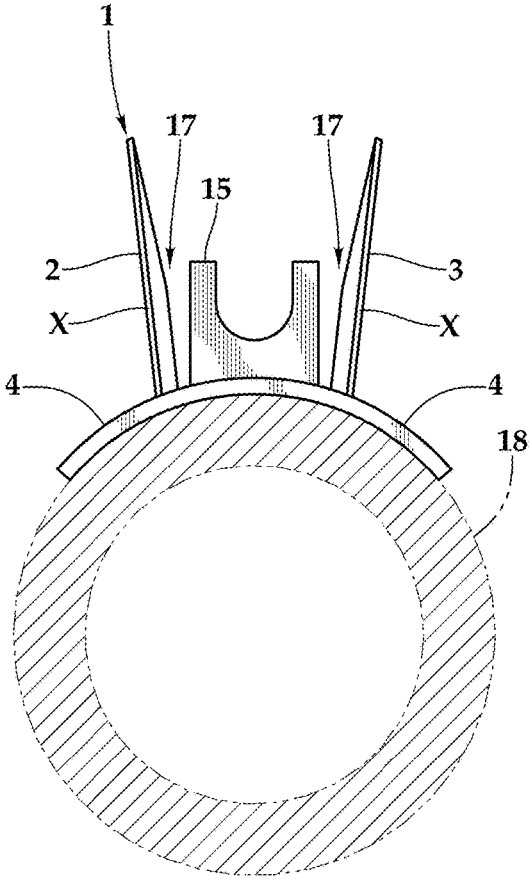
FIG. 14 is a rear view of the present invention shown in relation to a circular firearm barrel.

FIG. 13 is a front view of the present invention shown in relation to a firearm barrel, and FIG. 14 is a rear view of the present invention shown in relation to a firearm barrel. These two figures illustrate the near-perfect match between the curvature of the firearm barrel 18 and the curvature of the base member 4. They also show the slight outward splaying of the fins 2, 3 and the gap 17 between the ramp 15 and the fins. As shown in these two figures, the overall cross-sectional thickness of the ramp 15 preferably increases from front to back. (As used here, the term "front" means closest to the muzzle, and the term "back" means closest to the stock.) This is so that the back part of the ramp 15 (which is not supported by the base member 4) has sufficient structural integrity while providing elevation to the rear firearm sight. When the invention is in use, the operator would grip the rear part of the elevator 1 at the fins 2, 3, position the elevator on the firearm as shown in FIG. 5, and push the elevator forward (toward the muzzle end of the firearm) until the desired position is reached. This can be done while holding the firearm in a shooting position or with the firearm in a non-shooting position with reference to the sight markings.

Figure 15:
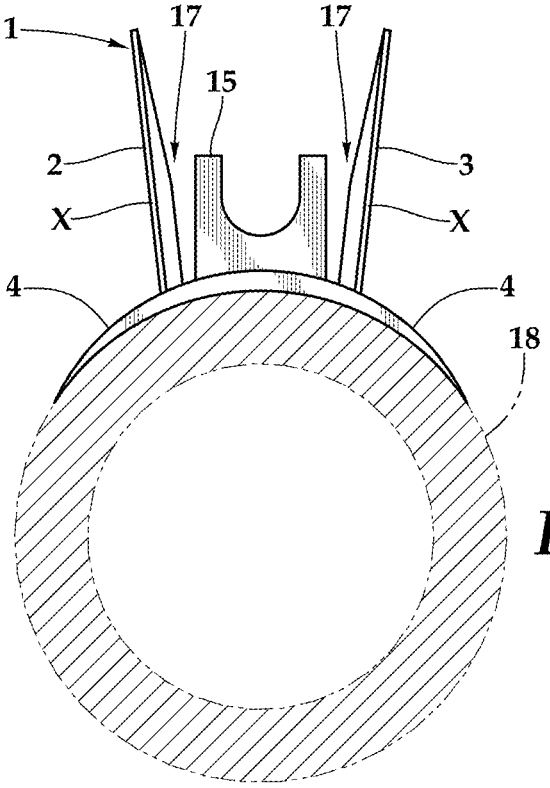
FIG. 15 is a rear view of an alternate embodiment of the present invention in which the outer edges of the base member are tapered.

FIG. 15 is a rear view of an alternate embodiment of the present invention in which the outer edges of the base member are tapered. In this embodiment, the outer edges of the base member 4 are tapered, as shown, to provide greater flex against the firearm barrel.

Figure 16:
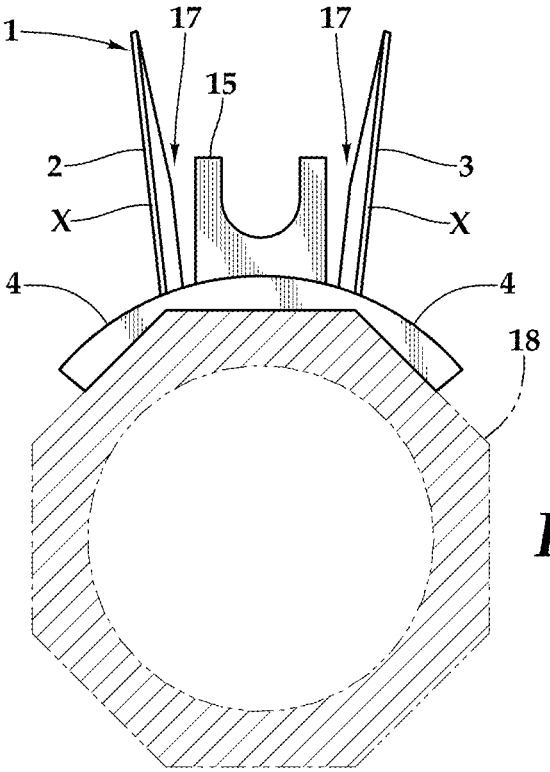
FIG. 16 is a rear view of an alternate embodiment of the present invention in which the base member is shaped to conform to an octagonal firearm barrel.

FIG. 16 is a rear view of an alternate embodiment of the present invention in which the base member is shaped to conform to an octagonal firearm barrel. In this embodiment, the top of the base member 4 is still convex in shape (as shown in FIG. 14), but the bottom of the base member is octagonal in shape (while still maintaining a general concavity) to conform to an octagonal firearm barrel. In a preferred embodiment, the bottom of the base member is configured (shaped) to fit the barrel shape and dimensions.

The present invention has several advantages over the prior art, including the fact that it does not require the use of both hands to adjust sight elevation settings. Prior art rear sight elevators require an operator to lift the rear sight with one hand and then move the rear firearm sight step elevator with the other. The present invention can be slid with one hand and is easy to handle and grip.

The present invention also allows an operator to change the elevation setting of a rear firearm sight more quickly with a single action of one hand, sliding the elevator forward or backward. Prior art rear sight elevators required the operator to stabilize the firearm and then lift the rear sight with one hand while moving the rear firearm sight step elevator with the other hand. The present invention can be installed in less than two seconds without tools by holding the firearm with one hand and sliding the elevator under the rear sight with the other hand.

Other advantages of the present invention include the fact that it provide easily readable detailed sight elevation reference markings on the side of the elevator. In addition, it allows the operator to achieve a relatively high sight setting without obstruction the operator's view of the front sight. Prior art sight elevators only allow for short to medium settings before the front sight becomes obscured or the elevator becomes unstable.

The present invention enables an operator to adjust the sight elevation even with a weak grip, cold fingers, or while wearing gloves. Prior art step sight elevators can only be manipulated with a significant amount of focused fingertip pressure, and the parts are very small.

Lastly, the concave shape of the base member and the wings enables the present invention to hug or grip the firearm barrel while still being able to slide, providing greater stability to the sight elevator, which in turn translates to greater accuracy in terms of the overall performance of the firearm.

FIGS. 17-32 show an alternate embodiment of the present invention. This embodiment comprises a base member and ramp, as in the embodiments shown in the preceding figures, but the rear firearm sight is held in place by teeth that come into contact with the top edge of the sight rather than ridges that come into contact with both sides of the sight, as in the embodiments described above. Rather than having two side fins, the alternate embodiment is in the form of two parallel clips. The bottom part of each clip forms one half of the ramp upon which the sight slides, and the top part of each clip comprises the teeth that maintain the sight at a given elevation. The rear part of each clip acts as a hinge. This embodiment is described more fully below.

Figure 17:
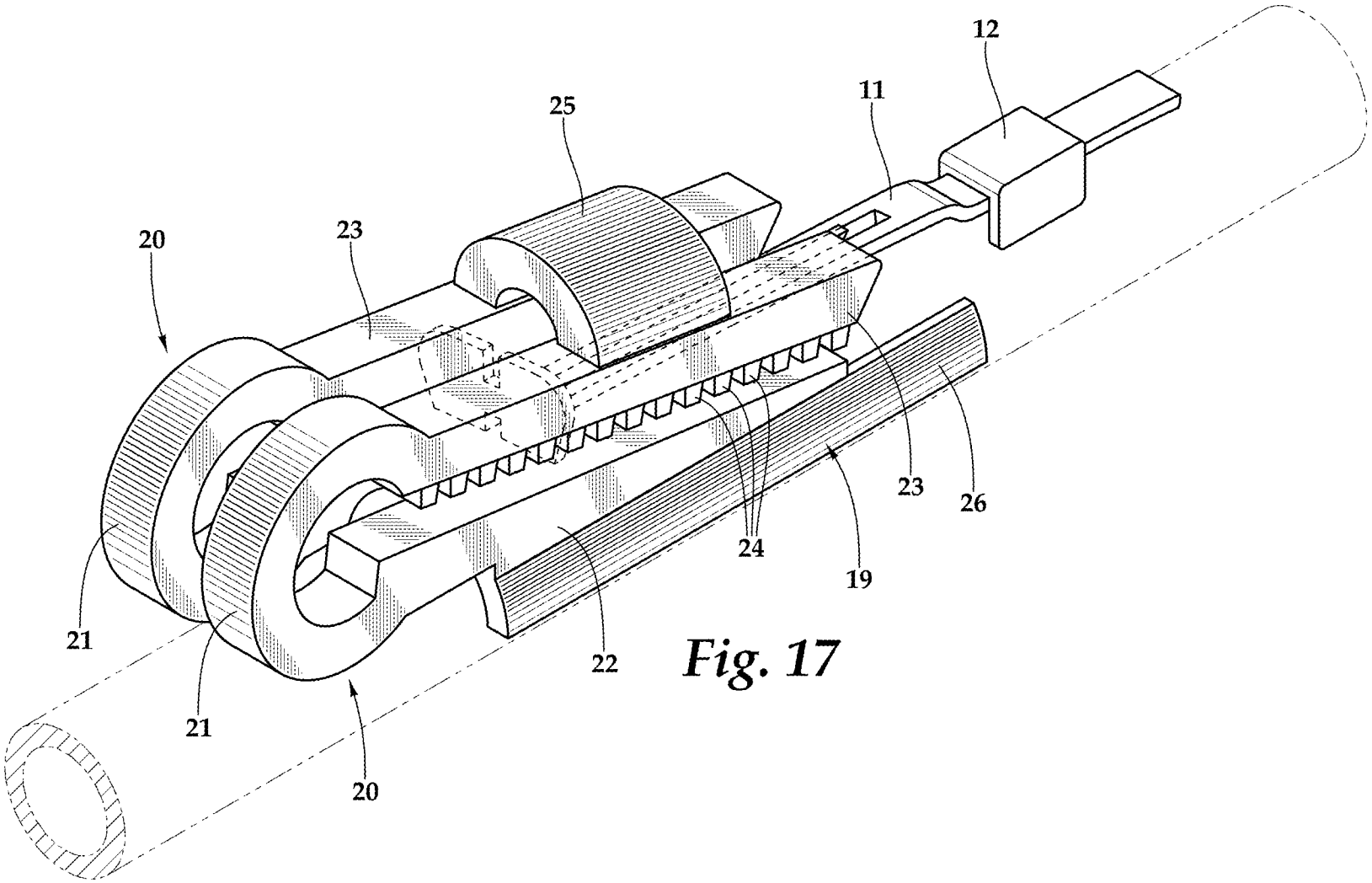
FIG. 17 is a rear perspective view of the present invention shown with an alternate embodiment of the rear firearm sight slide elevator installed on a firearm barrel.

FIG. 17 is a rear perspective view of the present invention shown with an alternate embodiment of the rear firearm sight slide elevator installed on a firearm barrel. As in the previous embodiments, this embodiment comprises a base member 19 that is configured to surround at least part of a firearm barrel. Two parallel clips 20 are situated on top of the base member 19. The rear end of each clip 20 is in the form of a rounded hinge 21, which acts as a flex point for the clip. The bottom part of the clip 20 is in the form of an elongated ramp 22, and the top part of the clip 20 is in the form of an elongated member 23 with a plurality of teeth 24 on the bottom surface of the elongated member 23. An optional arch-shaped bridge 25 connects the two elongated members 23 and maintains them at a certain lateral distance from each other.

Figure 18:
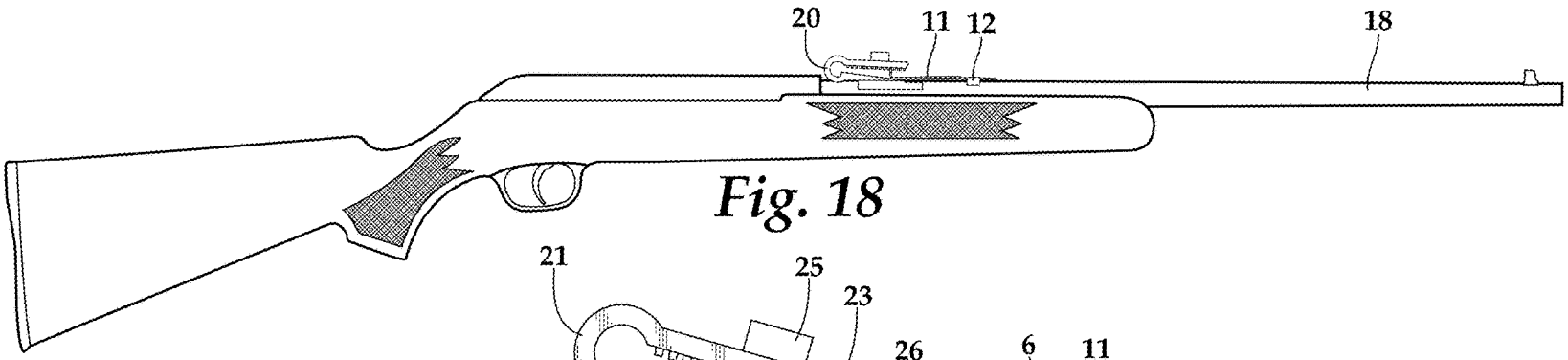
FIG. 18 is a side view of a rifle with an alternate embodiment of the rear firearm sight slide elevator of the present invention installed on the firearm.
Figure 19:
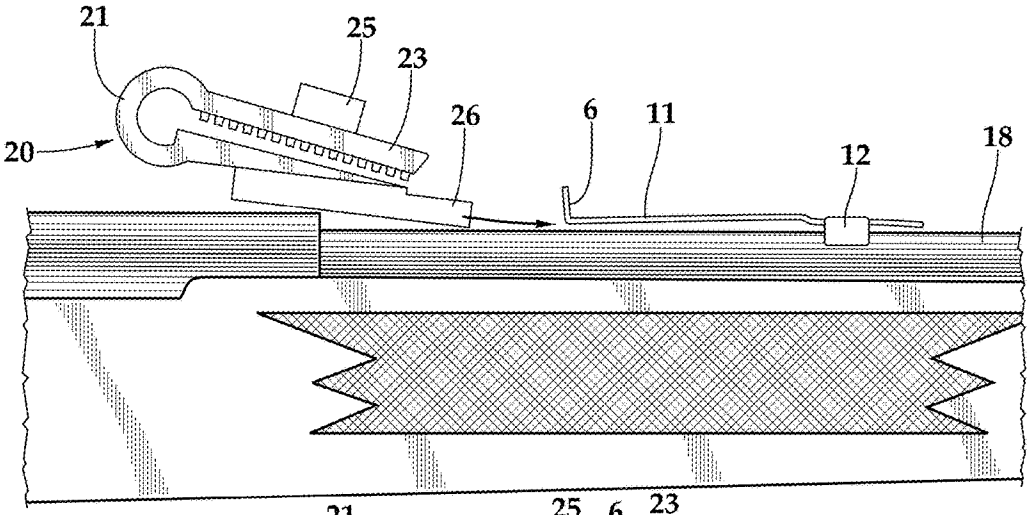
FIG. 19 is a detail side view of an alternate embodiment of the rear firearm sight slide elevator of the present invention shown in relation to the rear sight of the firearm prior to installation.
Figure 20:
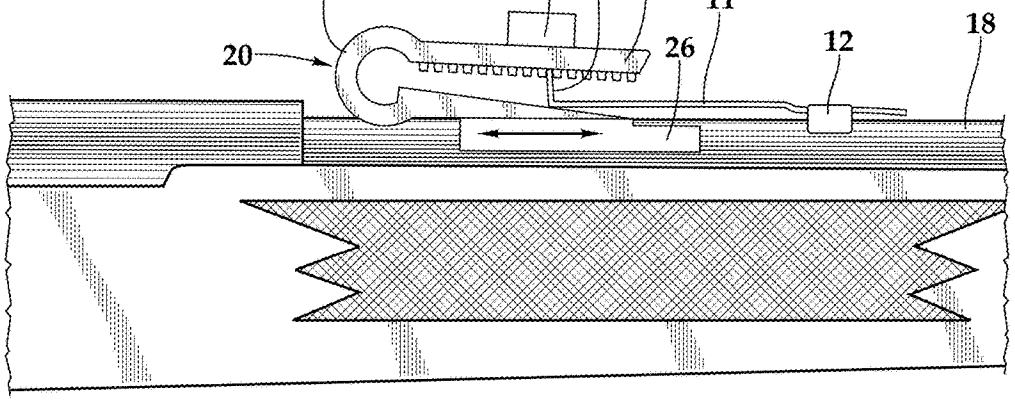
FIG. 20 is a detail side view of an alternate embodiment of the rear firearm sight slide elevator of the present invention shown in relation to the rear sight on the firearm after installation.

FIG. 18 is a side view of a rifle with an alternate embodiment of the rear firearm sight slide elevator of the present invention installed on the firearm. In this embodiment, the sight elevator is installed from the rear of the firearm (toward the stock), similar to what is described above in connection with FIG. 3. As shown in these two figures, the base member 19 preferably comprises a pair of wings 26 that extend forwardly from either side of the front end of the base member. The purpose of the wings 26 is to grab the barrel 18 and ensure that the sight 6 is placed at the base of the ramp 22 on the bottom of each clip 20. As manual force is applied to the sight elevator by the user in a forward (toward the muzzle) direction, the sight comes into contact with the front end of the ramp 22 and is elevated as additional pressure is placed on the sight elevator in a forward direction. As this happens, each clip 20 is pushed open by the sight 6, increasing the distance between the top and bottom parts of the clip. Alternately, the user can lift the top part of the clip away from the bottom part to insert or adjust the sight. This movement is facilitated by the hinge 21, which allows the top part of the clip (elongated member 23) to flex relative to the bottom part/ramp 22.

Figure 21:
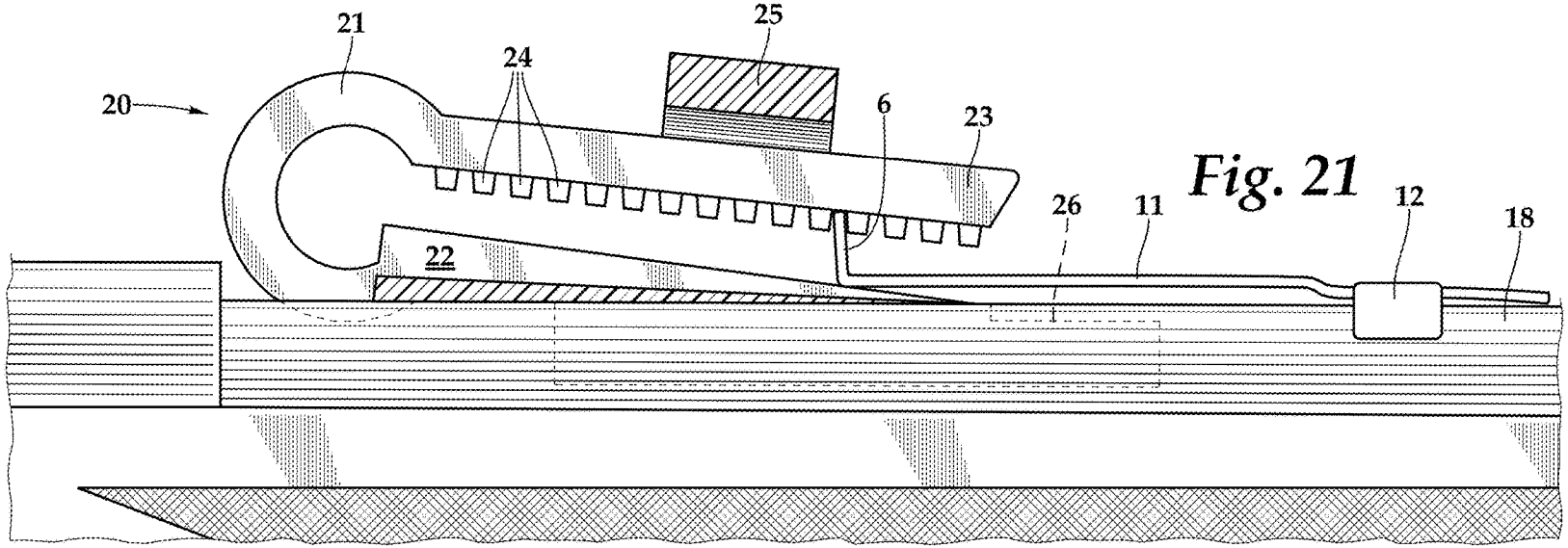
FIG. 21 is a detail section view of an alternate embodiment of the present invention installed on the firearm with the rear sight in a first position in relation to the rear firearm sight elevator.
Figure 22:
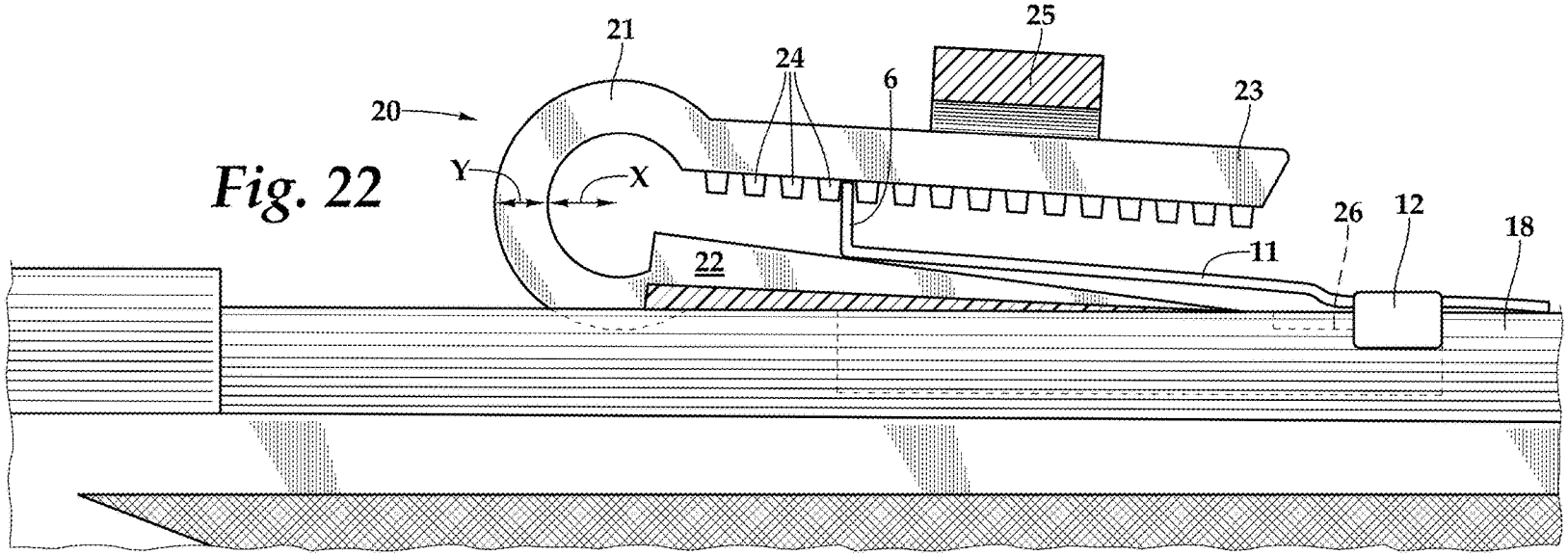
FIG. 22 is a detail section view of an alternate embodiment of the present invention installed on the firearm with the rear sight in a second position in relation to the rear firearm sight elevator.

FIG. 21 is a detail section view of an alternate embodiment of the present invention installed on the firearm with the rear sight in a first position in relation to the rear firearm sight elevator, and FIG. 22 is a detail section view of an alternate embodiment of the present invention installed on the firearm with the rear sight in a second position in relation to the rear firearm sight elevator. As shown in both of these figures, the ramp 22 increases in height from front to back (that is, from right to left in FIGS. 21 and 22), and the teeth 24 hold the sight 6 in a given position on the ramp. In a preferred embodiment, the elongated ramp 22 and the elongated member 23 are approximately the same length, and the teeth 24 are evenly spaced along the bottom surface of the elongated member 23. The rounded hinge 21 is in the form of a partial circle (greater than a semicircle but not a complete circle), with one end of the hinge 21 connected to a first (rear) end of the elongated member 23 and the other end of the hinge 21 connected to a first (rear) end of the elongated ramp 22. In a preferred embodiment, the elongated member 23, teeth 24, rounded hinge 21 and elongated ramp 22 are comprised of a single, plastic injection-molded part. The wings 26 extend in a forward direction (that is, to the right in FIGS. 21 and 22) beyond the front end of the elongated ramp 22. The rounded hinge 21 has a radius (marked as "X" on FIG. 22) that is slightly greater than the width (marked as "Y" on FIG. 22) of the rounded hinge 21 itself. This ratio helps ensure that the clip 20 applies the proper degree of force on the sight 6. Note that in FIGS. 21 and 22, only one clip 20 is shown, but the invention comprises two parallel clips, as noted above. See also FIG. 25.

Figure 23:
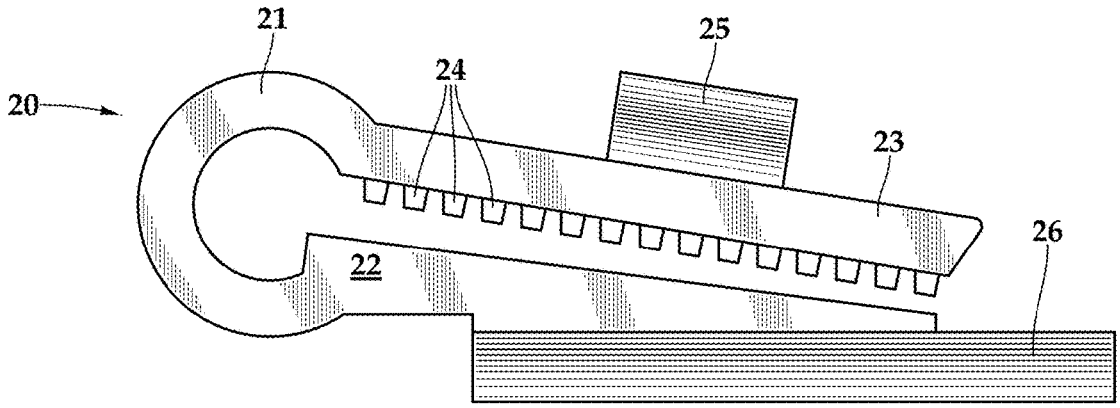
FIG. 23 is a side view of an alternative embodiment of the present invention.

FIG. 23 is a side view of an alternative embodiment of the present invention. This figure clearly shows the wings 26, which extends forwardly from the front edge of the elongated ramp 22, as noted above. When the clip 20 is in a resting position, as shown here, without the sight 6 inserted into the clip 20, the elongated ramp 22 and elongated member 23 are virtually parallel to each other.

Figure 24:
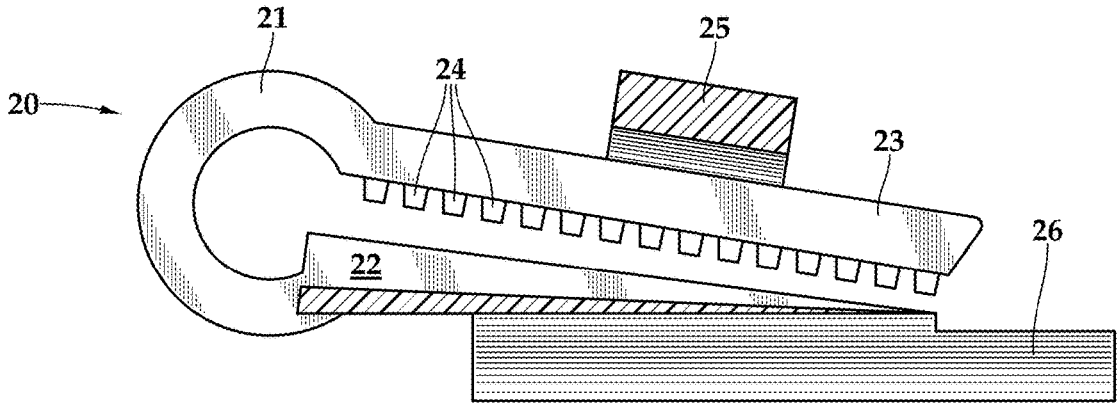
FIG. 24 is a longitudinal section view of an alternative embodiment of the present invention.

FIG. 24 is a longitudinal section view of an alternative embodiment of the present invention. In this view, only one of the clips 20 is shown. (In FIG. 23, a second clip 20 would be directly behind the first clip.) The section view is taken from the line shown in FIG. 25. Although the front end of the elongated member 23 is shown as angled in this figure (that is, tapered so that the top of the front end is slightly forward of the bottom of the front end), the front end of the elongated member 23 may also be rounded (not shown).

Figure 25:
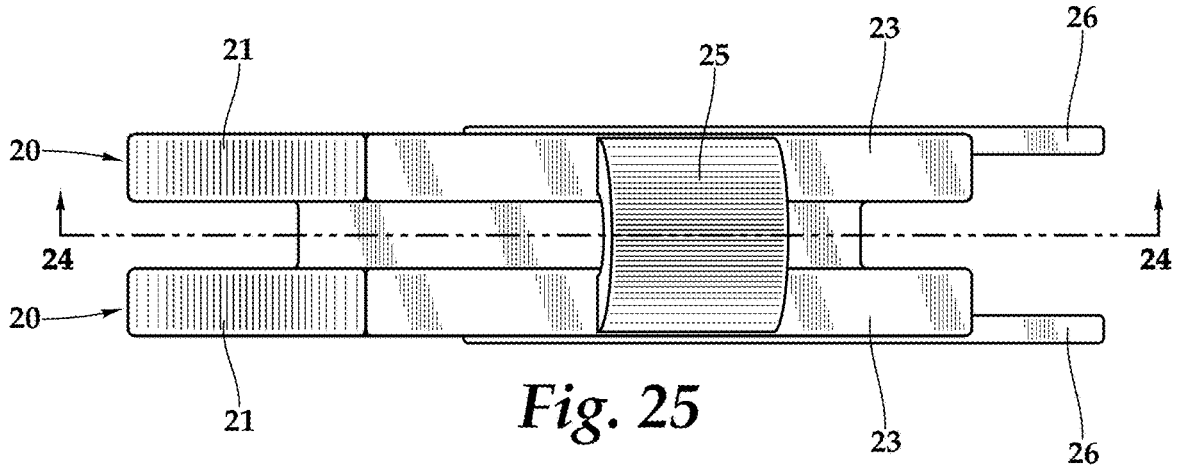
FIG. 25 is a top view of an alternative embodiment of the present invention.

FIG. 25 is a top view of an alternative embodiment of the present invention. The bridge 25 is preferably positioned on top of the elongated members 23 at a point that is between the front end of each elongated member 23 and the rear end of the elongated member, which transitions directly into the rounded hinge 21.

Figure 26:
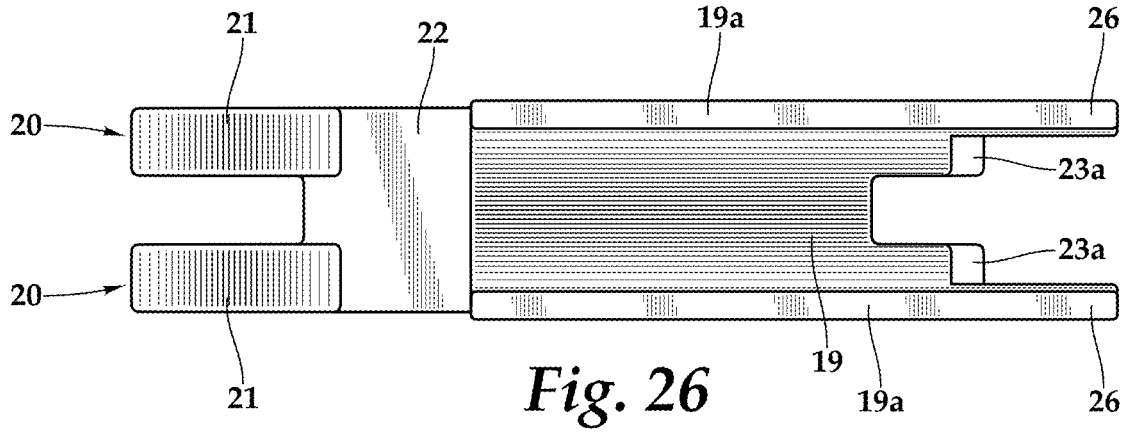
FIG. 26 is a bottom view of an alternate embodiment of the present invention.

FIG. 26 is a bottom view of an alternate embodiment of the present invention. As shown in this figure, the tapered ends 23*a* of the elongated members 23 extend forwardly (that is, to the right in FIG. 26) past the front end of the base member 19. The two rounded hinges 21, are parallel to each other, as are the bottom edges 19*a* of the base member 19.

Figure 27:
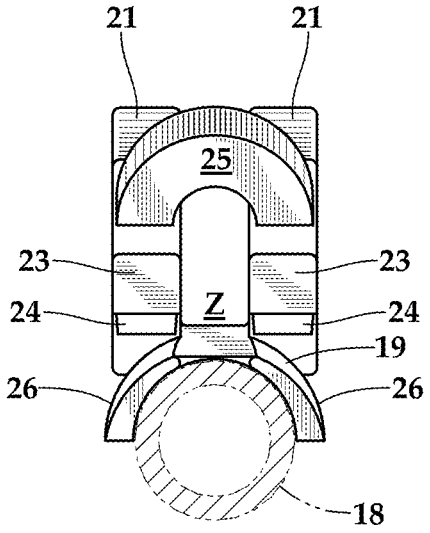
FIG. 27 is a front view of an alternate embodiment of the present invention shown in relation to a circular firearm barrel.
Figure 28:
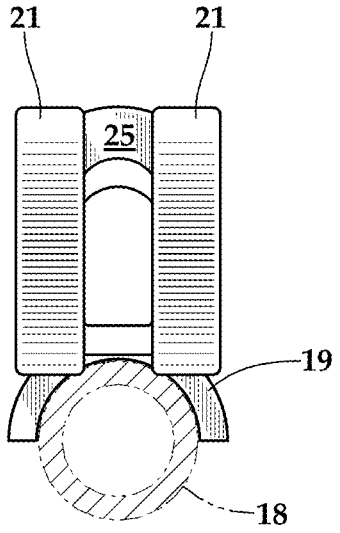
FIG. 28 is a rear view of an alternate embodiment of the present invention shown in relation to a circular firearm barrel.

FIG. 27 is a front view of an alternate embodiment of the present invention shown in relation to a circular firearm barrel, and FIG. 28 is a rear view of an alternate embodiment of the present invention shown in relation to a circular firearm barrel. In these figures the front end of the invention is the end that would be closest to the muzzle when the sight elevator is installed on the firearm. Conversely, the rear end of the invention is the end that would be closest to the stock when the sight elevator is installed on the firearm. It should be apparent from both of these figures that the present invention allows the firearm user to align the front and rear firearm sights (not shown) without obscuring the visibility of both sights. When the invention is in use and installed on a firearm, the front and rear sights would be aligned in the vicinity of "Z" on FIG. 27. In addition, although the shape of the firearm barrel 18 is shown here is circular, the firearm barrel may take alternate shapes, such as that shown in FIG. 16, in which case the base member 19 would be configured to fit around the firearm barrel. In addition, the outer edges of the base member may be tapered, as shown in FIG. 15.

Figure 29:
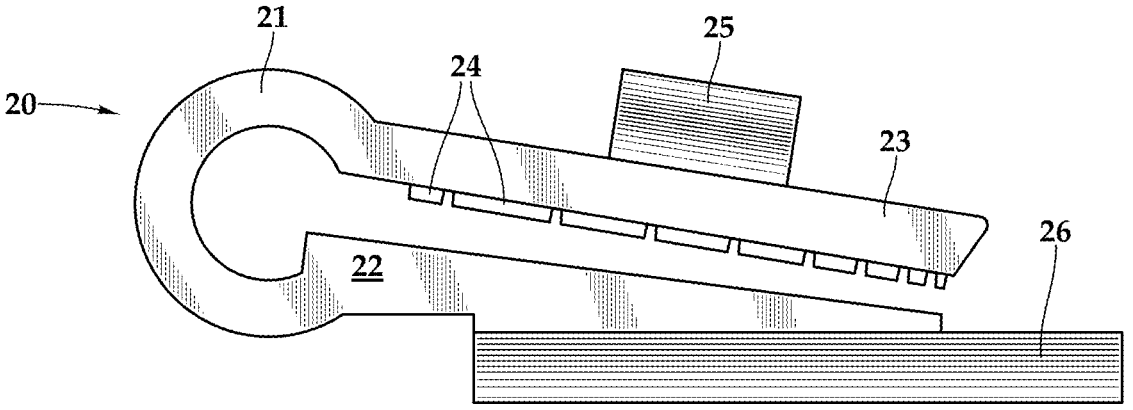
FIG. 29 is a side view of an alternative embodiment of the present invention in which the teeth on the elongated member are unevenly spaced.
Figure 30:
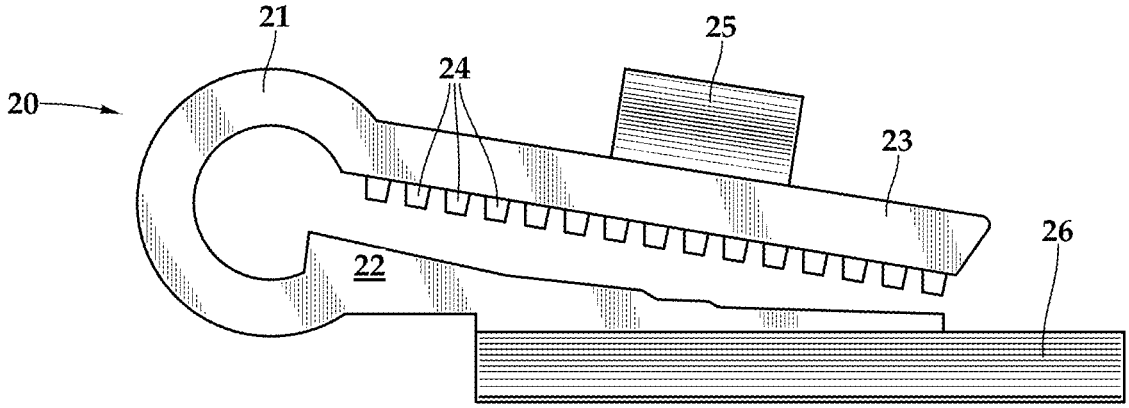
FIG. 30 is a side view of an alternative embodiment of the present invention in which the top surface of the elongated ramp is variegated rather than smooth.
Figure 31:
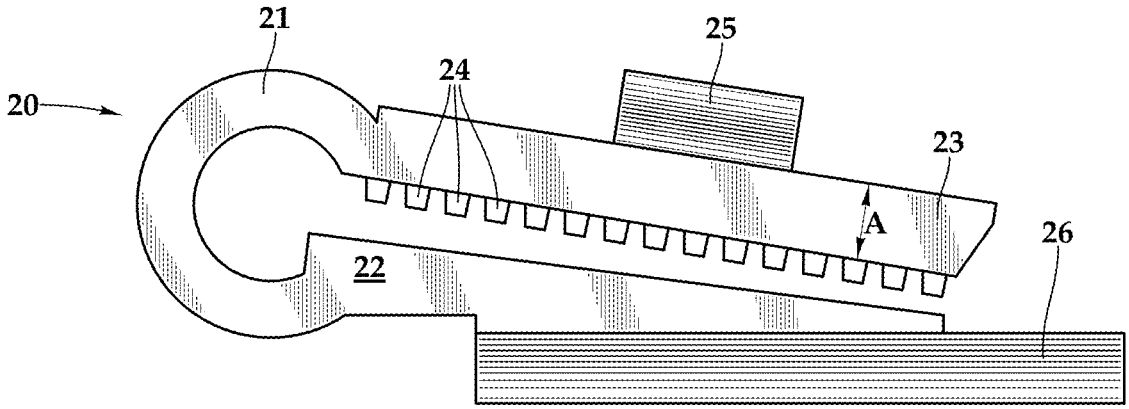
FIG. 31 is a side view of an alternative embodiment of the present invention in which the thickness of the elongated member is greater than that shown in FIG. 23.

FIGS. 29-32 illustrate three different variations of the embodiment shown in FIGS. 17-28. In FIG. 29, the teeth 24 are no longer evenly spaced. Instead, they are unevenly spaced to correspond to certain firearm sight settings. In FIG. 30, the top surface of the elongated ramp 22 is no longer smooth. Instead, it is variegated to correspond to certain firearm sight settings. Finally, in FIG. 31, the thickness (as indicated by the letter "A") of the elongated member 23 has been increased as compared to FIG. 23, The present invention, however, is not limited to any particular thickness of the elongated member 23.

Figure 32:
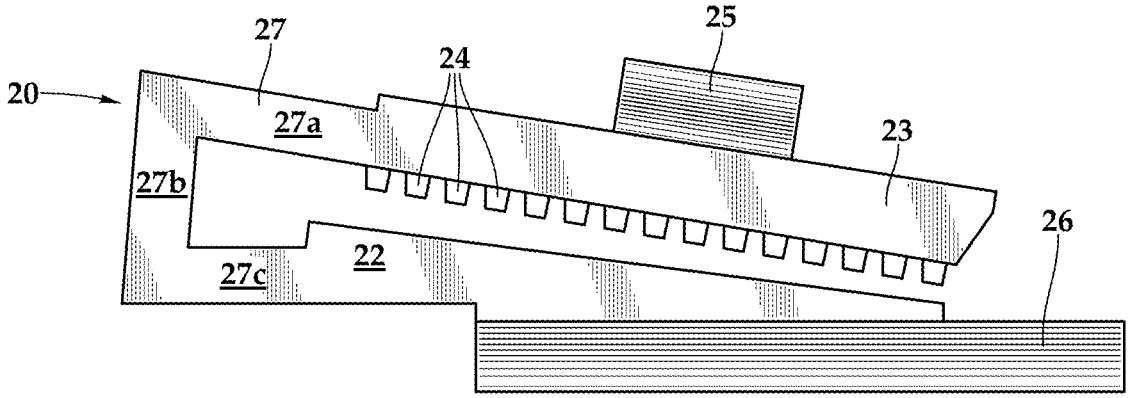
FIG. 32 is a side view of an alternative embodiment of the present invention in which the hinge is rectangular rather than round.

FIG. 32 is a side view of an alternative embodiment of the present invention in which the hinge is rectangular rather than round. The rectangular hinge 27 serves the same purpose as the rounded hinge 21. All other aspects of the invention are the same. The rectangular hinge 27 is comprised of a first edge 27*a*, a second edge 27*b*, and a third edge 27*c*. The second edge connects the first edge to the third edge. The angle between the first and second edges is equal to or less than ninety degrees, and the angle between the second and third edges is equal to or less than ninety degrees.

Although the preferred embodiments of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A rear firearm sight slide elevator comprising:

(a) a base member;

wherein the base member is configured to surround a part of a firearm barrel; and (b) a first clip and a second clip;

wherein the first clip and the second clip are situated on top of the base member and parallel to each other, with the first clip situated along a first side of the base member and the second clip situated on a second side of the base member;

wherein each of the first clip and the second clip comprises a top part in the form of an elongated member, a bottom part in the form of an elongated ramp, and a hinge that connects the top part to the bottom part at a rear end of the clip; and wherein the elongated member comprises a plurality of teeth that extend downwardly from a bottom surface of the elongated member.

2. The rear firearm sight slide elevator of claim 1, wherein the hinge is rounded.

3. The rear firearm sight slide elevator of claim 1, wherein the hinge is comprised of a first edge, a second edge, and a third edge, the second edge connecting the first edge to the third edge, the angle between the first and second edges being equal to or less than ninety degrees, and the angle between the second and third edges being equal to or less than ninety degrees.

4. The rear firearm sight slide elevator of claim 1, wherein the ramp comprises a top surface that is smooth.

5. The rear firearm sight slide elevator of claim 1, wherein the ramp comprises a top surface that is comprised of discrete steps.

6. The rear firearm sight slide elevator of claim 1, wherein the teeth are of equal width and evenly spaced.

7. The rear firearm sight slide elevator of claim 1, wherein the teeth are not of equal width and are not evenly spaced.

8. The rear firearm sight slide elevator of claim 1, further comprising a bridge that is connected on one end to a top surface of the elongated member on the first clip and on another end to a top surface of the elongated member on the second clip.

9. The rear firearm sight slide elevator of claim 1, further comprising a pair of wings that extend forwardly from either side of a front end of the base member.

* * * * *